US007479025B2

(12) United States Patent
Lee et al.

(10) Patent No.: US 7,479,025 B2
(45) Date of Patent: Jan. 20, 2009

(54) ELECTRICAL CONNECTOR

(75) Inventors: Kien Sheng Lee, Singapore (SG); Chee Boon Vincent Lim, Singapore (SG)

(73) Assignee: MEA Technologies Pte. Ltd., Singapore (SG)

( * ) Notice: Subject to any disclaimer, the term of this patent is extended or adjusted under 35 U.S.C. 154(b) by 0 days.

(21) Appl. No.: 11/899,665

(22) Filed: Sep. 7, 2007

(65) Prior Publication Data

US 2008/0064250 A1 Mar. 13, 2008

(30) Foreign Application Priority Data

Sep. 8, 2006 (SG) ..... 200606189

(51) Int. Cl.
*H01R 13/627* (2006.01)

(52) U.S. Cl. ..... 439/349

(58) Field of Classification Search ..... 439/352, 439/349, 345, 370, 358, 489, 752
See application file for complete search history.

(56) References Cited

U.S. PATENT DOCUMENTS 5,823,813 A 10/1998 Dye
6,142,799 A * 11/2000 Marcel ..... 439/152
7,153,172 B2 * 12/2006 Milligan et al. ..... 439/752
2006/0264119 A1 * 11/2006 Milligan et al. ..... 439/752

FOREIGN PATENT DOCUMENTS

DE 10 2005 060 657 6/2007
JP 2004-63090 2/2004
WO WO-2004/095642 A2 11/2004
WO WO-2004/109866 A1 12/2004

OTHER PUBLICATIONS

Patent Abstracts of Japan for Japanese Publication No. 2004-063090, Publication date Feb. 26, 2004 (1 page).

* cited by examiner

*Primary Examiner*—Neil Abrams
*Assistant Examiner*—Phuong Nguyen
(74) *Attorney, Agent, or Firm*—Osha • Liang LLP

(57) ABSTRACT

An electrical connector includes a first connector part that has a male housing with an engaging portion formed on the outer periphery thereof; a second connector part 2 that has a female housing 3 provided with a portion defining a cavity for receiving the male housing; a sensor 7 that senses the mated state of the first and second parts; and a lock 6 that locks the first and second parts in the mated state at a regular mating position. The lock 6 is made of a clip member made of a spring wire-like body and has first latch portions 63A, 66A and a second latch portion 67A. The sensor 7 is made of a sliding sensing member having a sensing arm 73 made of a resilient piece provided with an engaging portion 73*a*' that latches into the second latch portion 67A.

6 Claims, 13 Drawing Sheets

(prior art)

ELECTRICAL CONNECTOR

BACKGROUND

1. Technical Field

The present invention relates to an electrical connector that includes a male connector part and a female connector part. More particularly the invention relates to an electrical connector that possesses sensing means able to sense the mated state of the two parts.

2. Related Art

Electrical connectors including a male connector part and a female connector part are generally provided with latching means to prevent the two parts from suddenly coming apart when coupled. However, it sometimes happens that during mating of the two parts, their contact pins become electrically coupled to each other with the parts in, for example, a semi-mated state. In such a case the two parts will be mated without their coupling being locked by the latching means, so that during use the two parts may suddenly come apart. Accordingly, some electrical connectors are provided with sensing means able to sense the mated state, in order to prevent such coupling in a semi-mated state (see, for example, JP-2004-63090-A).

The electrical connector set forth in JP-2004-63090-A has a pair of first and second connector parts 100 and 130 that mate together, the first part 100 being provided with a sensing member 120, as shown in FIG. 13. Inside the housing 101 of this first part 100 there is formed a receiving hole 102 for receiving a plurality of female pin metals. Provided on the top of the outside of this housing 101 is a flat locking arm 103 that is parallel with the mating direction of the two parts 100, 130. This locking arm 103 rises up from the front top edge of the housing 101, and extends cantilever-like toward the rear, almost parallel to the top surface of the housing 101 with a particular spacing therefrom, in such a manner as to be flexible in the vertical direction. Provided on the bottom surface of the locking arm 103, that is, the inner surface that faces the top surface of the housing 101, are a pair of latching protrusions 104F and 104R into which a flexible latching piece 121 included in the sensing member 120 latches. Further, the sensing member 120 has a guide portion 122, the flexible latching piece 121 that extends outward from the guide portion 122, and a gripping portion 123 that rises upward from the rear edge portion of the guide portion 122.

The sensing member 120 is able, in the state where the bottom surface of its guide portion 122 is in contact with the top surface of the housing 101 and at least its front end portion is held between the housing 101 and the locking arm 103, to move back and forth between a standby position and a sensing position forward of the standby position. Thanks to this structure, a semi-mated state can be sensed by moving the sensing member during mating of the first and second parts.

Similarly, in Patent Publication Nos. WO2004/109866 and WO2004/095642, electrical connectors are set forth in which a locking arm possessing resilience is provided integrally with the top surface of the housing, locking protrusions are formed on the outer surface thereof, engaging protrusions are formed on the bottom surface, and a sensing member (CPA) is inserted into the locking arm's gap.

In each of the electrical connectors set forth in JP-2004-63090-A and Patent Publication Nos. WO2004/109866 and WO2004/095642, a locking arm possessing flexibility is provided integrally on the top surface of the housing, locking protrusions are formed on the outer surface thereof, latching protrusions are formed on the bottom surface, and a sensing member (CPA) is inserted into the gap between the locking arm and the housing's top surface. This means that the locking arm that is flexible enough for insertion of the CPA must be molded integrally with the housing's top surface. As a result, the shape of the housing is complex, the mold for its fabrication is complex, and the molding process is troublesome. Also, since the locking arm is molded integrally with the housing, the housing's outer dimensions are large, which means that the connector is large-size. Further, there are several other problems. One is that since the structure allows the sensing member to be inserted into the gap between the locking arm and the top surface of the housing even when the electrical connector is not mated together, and hence to be operated with the electrical connector in the unmated state, there is danger of erroneous operation. Another is that when the sensing member is inserted into the gap between the locking arm and the top surface of the housing in the unmated state, the CPA cannot be released without using a special tool.

SUMMARY

In consideration of such problems in the related art, an advantage of the present invention is to provide an electrical connector in which the operations of the sensing means and locking means are linked, so that mating and locking of the connector parts are reliable.

Another advantage of the present invention is to provide a simple-to-assemble and more compact electrical connector.

Accordingly, the electrical connector of claim 1 of the present invention includes: a first connector part that has a male housing provided with an engaging portion on the outer periphery thereof; a second connector part that has a female housing provided with a portion defining a cavity for receiving the male housing; sensing means that senses the mated state of the first and second parts; and locking means that locks the first and second parts in the mated state at a regular mating position. The locking means is made of a clip member made of a spring wire-like body and having a first latch portion that latches into the engaging portion of the male housing and a second latch portion that latches into the sensing means. The sensing means is made of a sliding sensing member having a sensing arm made of a resilient piece provided with an engaging portion that latches into the second latch portion of the clip member. The female housing at the outer wall thereof is provided with a portion defining a through-hole that projects the first latch portion of the clip member into the cavity. The spring wire-like body of the clip member is mounted onto the surface of this outer wall, and the sliding sensing member is fitted also onto the surface of this outer wall slidably in the mating direction of the first and second connector parts, so that with the first and second connector parts mated the first latch portion of the clip member engages with the engaging portion of the male housing, and the engaging portion of the sliding sensing member latches into the second latch portion of the clip member.

According to claim 2 of the present invention, in the electrical connector of claim 1, the spring wire-like body of the clip member is made of a single linear spring wire that is bent into a shape along the outer wall of the female housing, and the first and second latch portions are provided to the linear spring wire.

According to claim 3 of the present invention, in the electrical connector of claim 2, a section of the female housing that is orthogonal to the longitudinal direction thereof is rectangular, elliptical or circular, and the clip member is bent into a rectangular, elliptical or circular shape along the female housing and wound like a coil. The first latch portion includes a pair of opposed first and second protruding portions that project inward of the clip member. The second latch portion includes a third protruding portion located on a virtual line that is orthogonal to another virtual line joining the first and second protruding portions and projecting outward of the clip member.

According to claim 4 of the present invention, in the electrical connector of claim 1, the both ends of the clip member are provided with pressing portions for moving the first and second latch portions, and the first and second connector parts are decoupled by the pressing portions' being pushed.

According to claim 5 of the present invention, in the electrical connector of claim 1, the sliding sensing member includes a pair of opposed first and second sidewall portions that contact against the outer periphery of the female housing, and a coupling portion that couples the first and second sidewall portions, and the sensing arm made of a resilient piece is provided to the coupling portion.

According to claim 6 of the present invention, in the electrical connector of claim 5, each of the first and second sidewall portions is provided with a locking portion that inhibits actuation of the clip member with the first and second connector parts mated in the regular position.

The structures according to the present invention have the advantages that will now be described. According to the present invention as in claim 1, the locking means includes a clip member made of a spring wire-like body and possessing first and second latch portions, which is wound onto the outer wall surface of the female housing. By causing the clip member's first latch portions to engage with the male housing's engaging portion and the second latch portion to latch into the sliding sensing member's engaging portion when the first and second connector parts are mated, it is possible to prevent semi-mating of the first and second connector parts and the parts can be reliably locked. In other words, because the operations of the clip member and sliding sensing member are linked, the connector parts are mated and locked reliably.

Moreover, mounting of the clip member onto the female housing is effected by winding the member onto the outer wall surface of the female housing. Therefore such mounting does not require a specially complex shape to be used for the female housing. This means that the female housing is simple to mold, and the connector can be made compact. What is more, such mounting is simple.

According to the present invention as in claim 2, the clip member is formed by bend-processing a single linear spring wire, and therefore is extremely simple and low-cost to manufacture.

According to the present invention as in claim 3, because the clip member is formed by bend-processing a single linear spring wire, it can accommodate in a simple manner any changes that may be made to the shape of the housing. Also, the fact that the first latch portion includes the first and second protruding portions means that its engagement with the engaging portion of the male housing will be stable.

According to the present invention as in claim 4, the pressing portions for moving the first and second latch portions are formed at the both ends of the clip member, so that by pushing on the end portions, the clip member can be disengaged in a simple manner from the engaging portions of the male housing.

According to the present invention as in claim 5, the sliding sensing member has a pair of opposed first and second sidewall portions that contact against the outer periphery of the female housing, and a coupling portion that couples the first and second sidewall portions, with the sensing arm made of a resilient piece being formed on the coupling portion, thanks to which, the member has a simple structure and is easy to mount to the female housing. Further, because the sensing arm is constituted of a resilient piece, the resilience thereof can be utilized to move the sliding sensing member when the first and second connector parts are uncoupled, and hence there is no need for a special tool to release the arm from the clip member.

According to the present invention as in claim 6, each of the first and second sidewall portions is provided with the locking portion that inhibits actuation of the clip member when the first and second connector parts are mated in the regular position, thanks to which, with the first and second connector parts in the locked state, actuation of the sliding sensing member is impossible and the coupled state of the two parts can be maintained.

DETAILED DESCRIPTION OF THE PREFERRED EMBODIMENT

A preferred embodiment of the present invention will now be described with reference to the drawings. It should be understood however that the embodiment below is merely an illustrative example of an electrical connector for realizing the technical concepts of the present invention. This embodiment is not intended to limit the present invention to this particular electrical connector; the invention can equally well be adapted to yield other embodiments contained within the scope of the claims.

Embodiment 1

Figure 1:
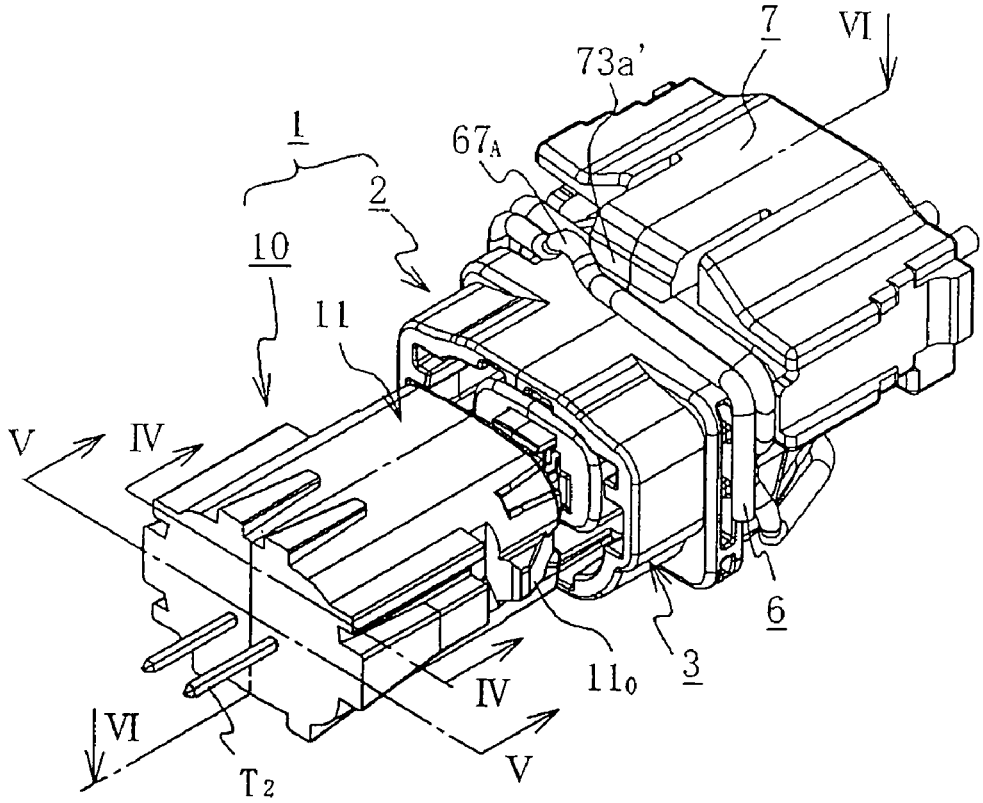
FIG. 1 is an exterior perspective view illustrating an electrical connector composed of a male connector part and a female connector part, in the state prior to coupling.
Figures 2A, 2B:
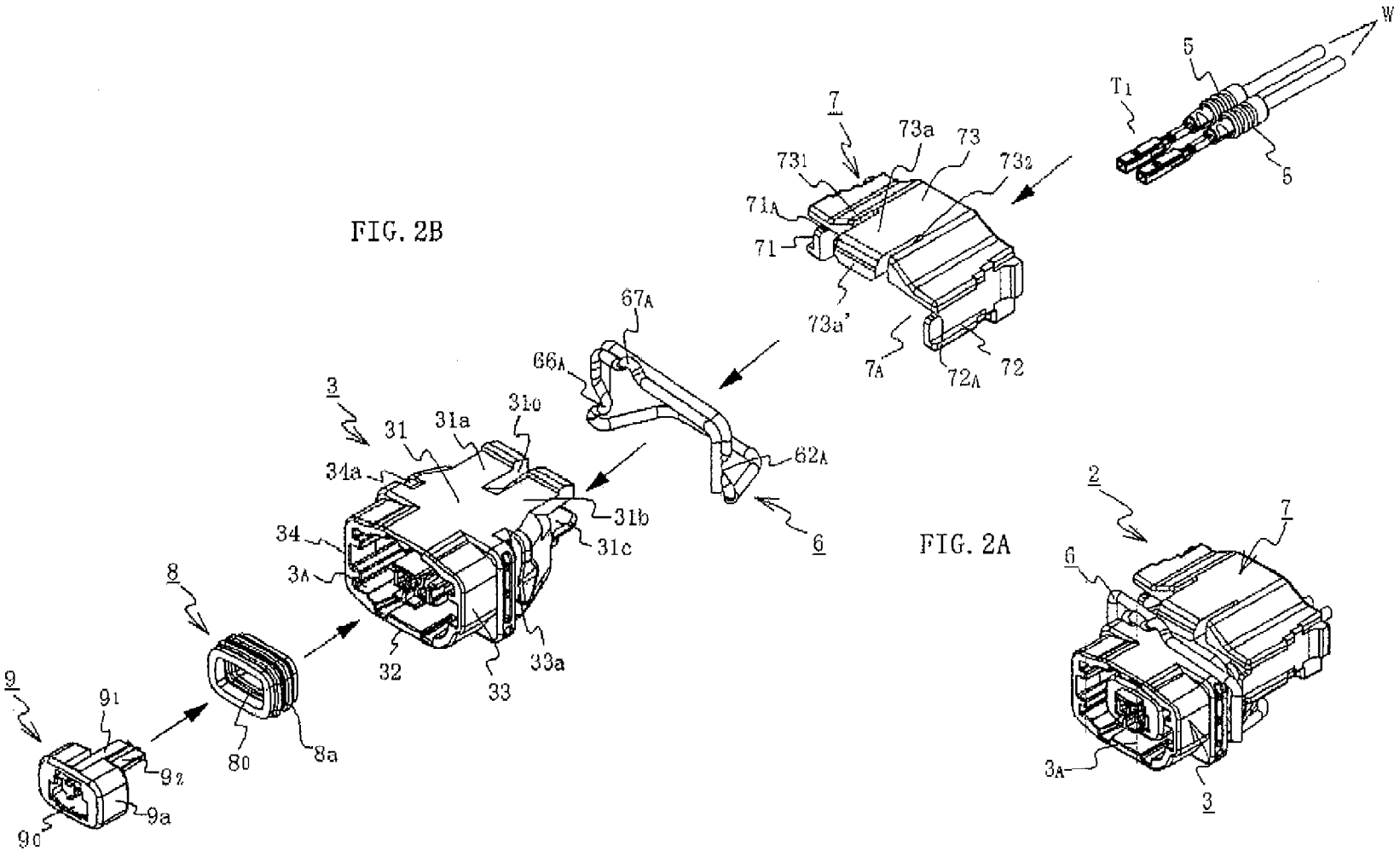
FIG. 2 is an exploded perspective view illustrating the female part in FIG. 1, FIG. 2A being a perspective view of the female part, and FIG. 2B being an exploded perspective view of the female part in FIG. 2A in the dismantled state.
Figure 3B:
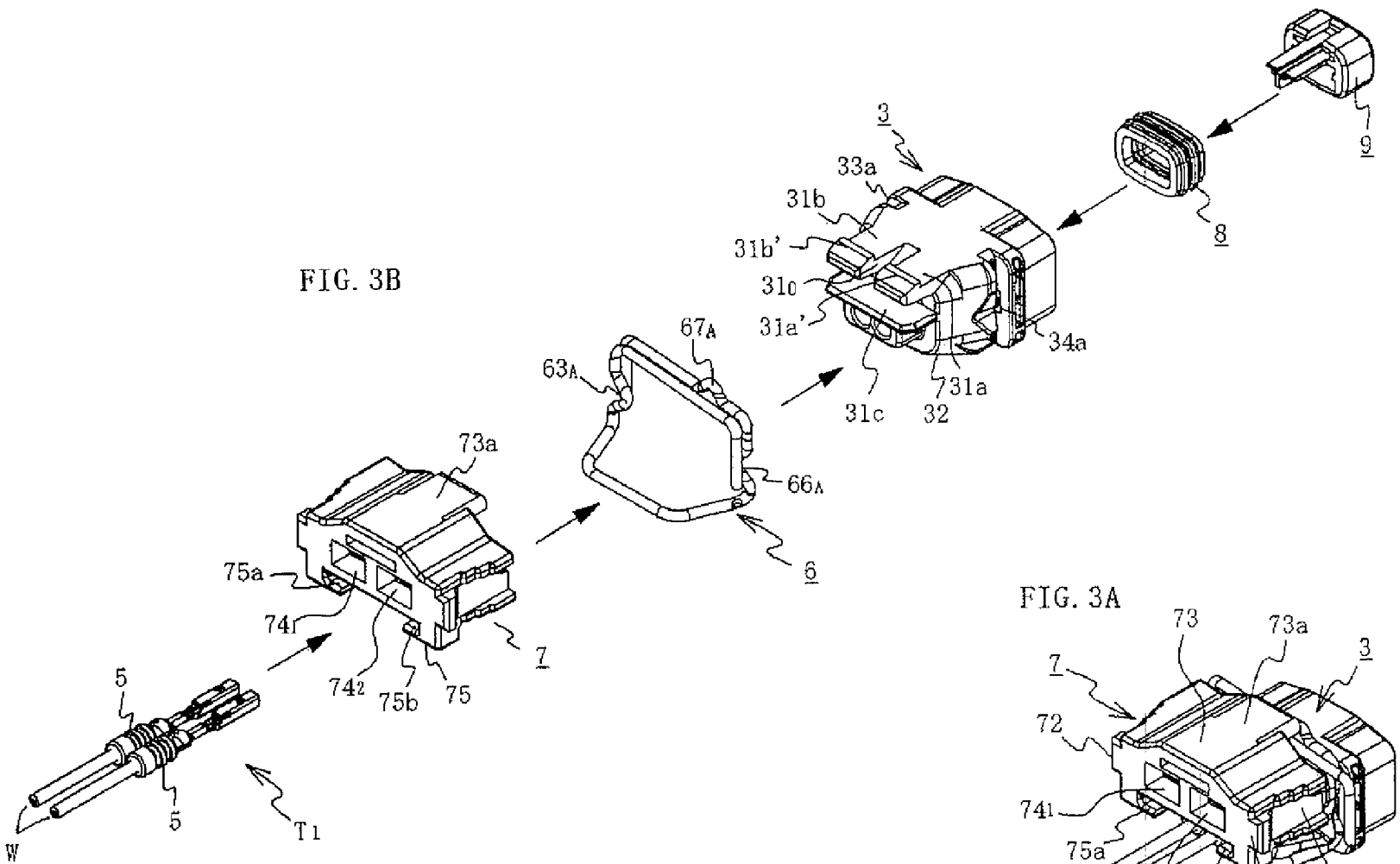
FIG. 3 illustrates the female part of FIG. 2 rotated 180 degrees, FIG. 3A being a perspective view corresponding to FIG. 2A and FIG. 3B being an exploded perspective view corresponding to FIG. 2B.
Figure 3A:
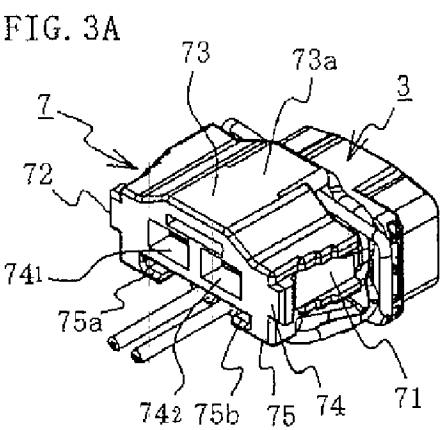
Figure 4:
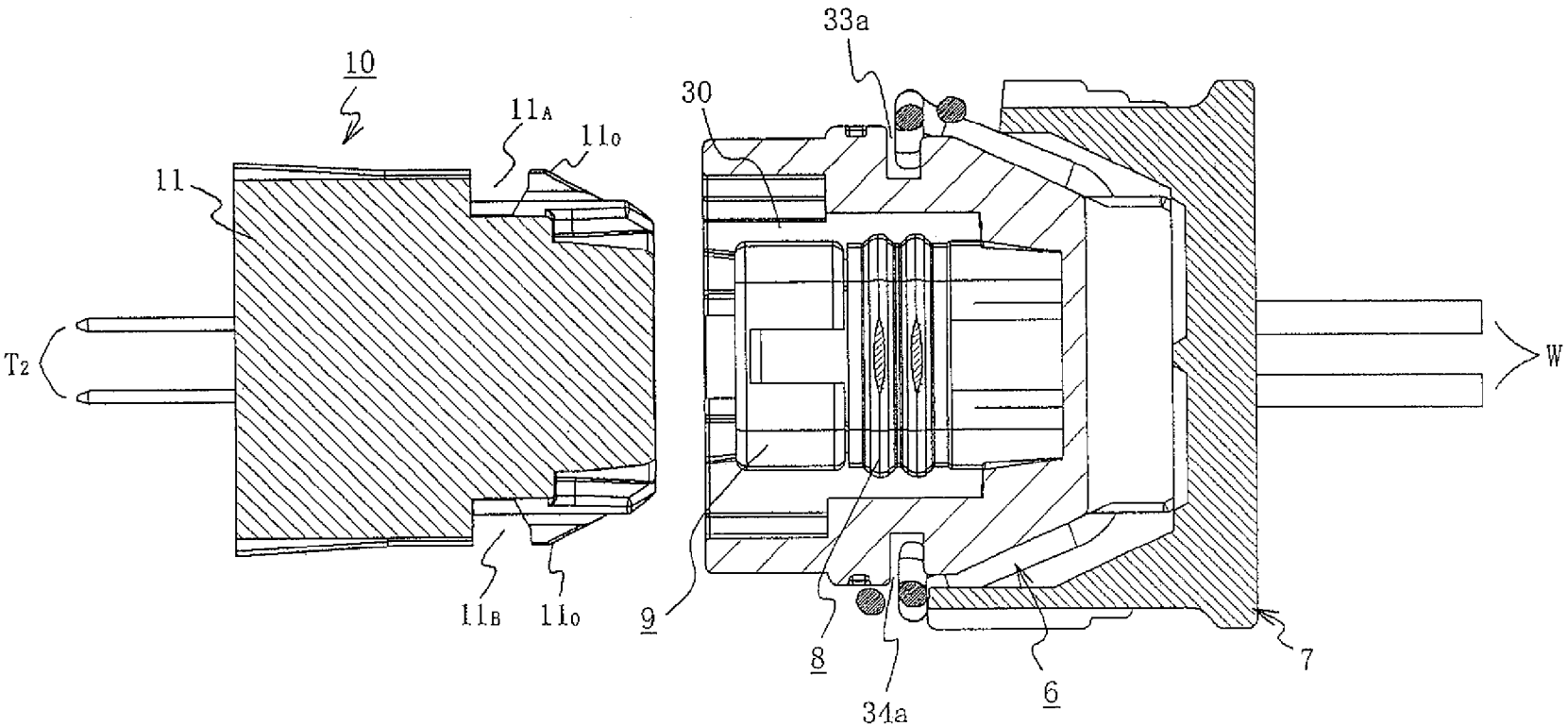
FIG. 4 is a sectional view cut along line IV-IV in FIG. 1.
Figure 5:
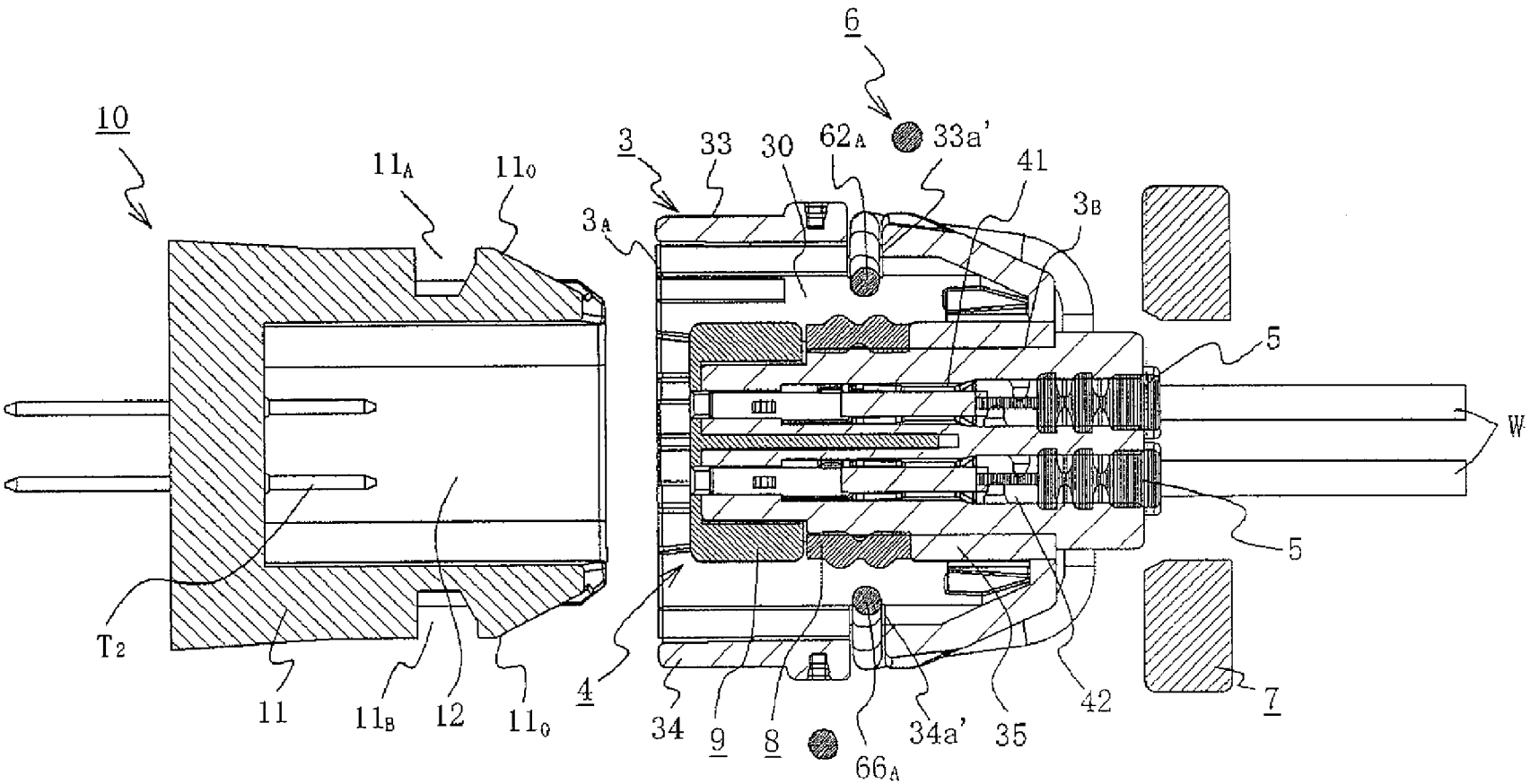
FIG. 5 is a sectional view cut along line V-V in FIG. 1.
Figure 6:
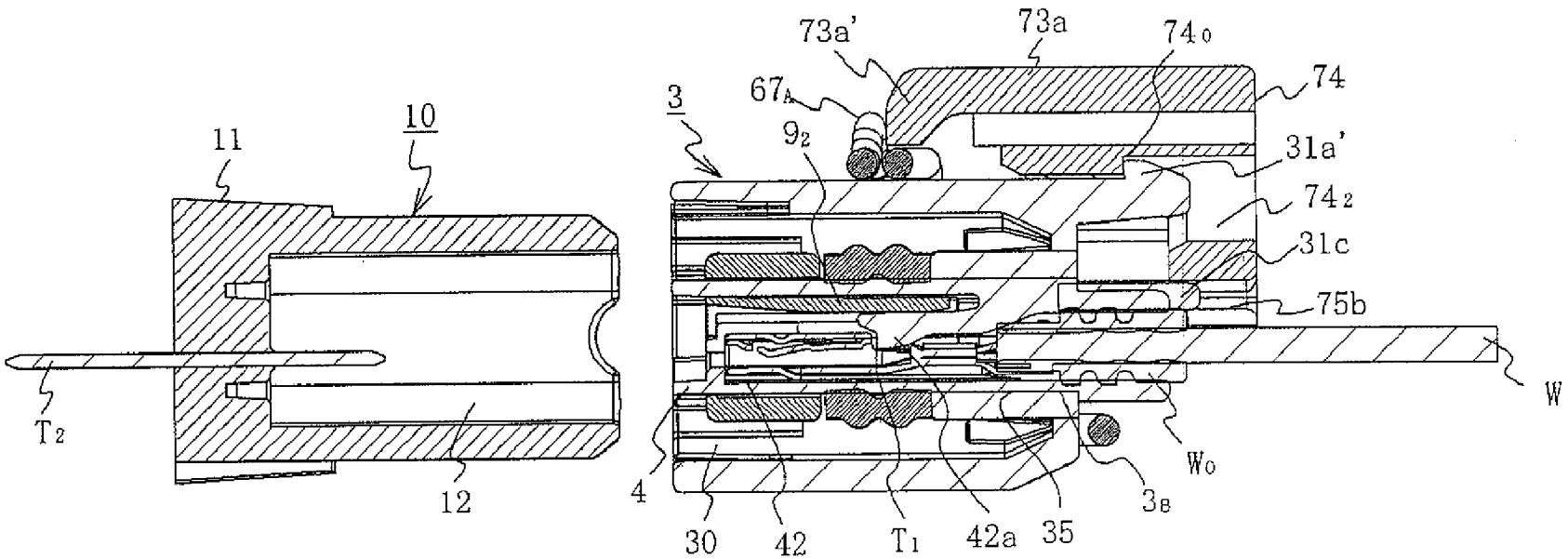
FIG. 6 is a sectional view cut along line VI-VI in FIG. 1.

FIG. 1 is an exterior perspective view illustrating an electrical connector composed of a male connector part and a female connector part, in the state prior to joining; FIG. 2 is an exploded perspective view illustrating the female part in FIG. 1, FIG. 2A being a perspective view of the female part and FIG. 2B being an exploded perspective view of the female part in FIG. 2A; FIG. 3 illustrates the female part of FIG. 2 rotated 180 degrees, FIG. 3A being a perspective view corresponding to FIG. 2A and FIG. 3B being an exploded perspective view corresponding to FIG. 2B; FIG. 4 is a sectional view cut along line IV-IV in FIG. 1; FIG. 5 is a sectional view cut along line V-V in FIG. 1; and FIG. 6 is a sectional view cut along line VI-VI in FIG. 1.

As shown in FIGS. 1 to 3, an electrical connector 1 has a female part 2 with a plurality of female contact pins $T_1$ mounted inside a female housing, and a male part 10 with male contact pins $T_2$, to which the female contact pins $T_1$ are electrically coupled, mounted inside a male housing 11; and the female part 2 is so structured that a sensing member (Connector Position Assurance; "CPA" below) 7 that senses the mated state with the male part 10 is mounted on the outer wall surface of the female housing. The female part 2 and male part 10 composing the electrical connector 1 will be described first below.

The female part 2 has two female contact pins $T_1$, $T_1$, a female housing in which the female contact pins $T_1$, $T_1$ are housed, and a tubular seal member 8 and contact latching member ("TPA" below) 9 that are installed inside the female housing's insertion opening $\mathbf{3}_A$.

The female housing has: at the front, an insertion opening $\mathbf{3}_A$ into which the housing of the male part 10 is inserted; at the rear, a tubular outer housing 3 with an opening $\mathbf{3}_B$ (see FIG. 5) into which an inner housing 4 is inserted; and in the interior, receiving holes 41 and 42 that receive the two female contact pins $T_1$, $T_1$; and is so configured that the inner housing 4 is tubular, is inserted into the outer housing 3's opening $\mathbf{3}_B$, and fits over the male housing 11 of the male part 10 (see FIG. 5).

The outer housing 3's insertion opening $\mathbf{3}_A$ takes a rectangular shape with mutually opposed short edges and long edges, while its outer periphery is covered by mutually opposed left and right sidewalls 33 and 34, and top and bottom walls 31 and 32. Also, the outer housing 3 has a cavity 30 (see FIGS. 4 and 5) formed in its interior, the whole being formed as an insulating plastic molding in a flattened tubular shape. Flat-bottomed slots 33*a* and 34*a* are formed in a roughly central position along the outer periphery of the outer housing 3 in the longitudinal direction, or more specifically, on the respective outer faces of the left and right sidewalls 33, 34. The width and depth of the flat-bottomed slots 33*a*, 34*a* are sufficiently large to receive the wire-like body of the clip member 6 to be described later. Roughly in the center of the flat-bottomed slots 33*a*, 34*a* there are formed through-holes 33*a*' and 34*a*' that penetrate through the sidewalls (see FIG. 5). The latching protrusions $\mathbf{62}_A$ and $\mathbf{66}_A$ of the clip member 6 are projected through these through-holes 33*a*', 34*a*'.

Further, two arm pieces 31*a* and 31*b* possessing resilience are extended from the outer face of the top wall 31, and at the end of each arm piece 31*a*, 31*b* there are formed upward-protruding hook-like latching claws 31*a*' and 31*b*' (see FIG. 3). The resilience of the arm pieces 31*a*, 31*b* stems from the material of the outer housing 3, the thickness of the top wall 31, and a narrow slot $\mathbf{31}_0$ set in the top wall 31 in the longitudinal direction. Also, a guiding tab 31*c* for guiding the sliding motion of the CPA 7 is formed at the rear of the outer housing 3. Moreover, in the bottom wall 32 of the outer housing 3 there is formed a step portion $\mathbf{32}_0$ into which the bottom portion 60B of the clip member 6 latches (see FIG. 11B).

The inner housing 4 is constituted of a rectangular tubular body and is formed as an insulating plastic molding, as shown in FIGS. 1 and 4 to 6. Receiving holes 41 and 42 into which the two female contact pins $T_1$, $T_1$ fit are formed to penetrate into the interior of the inner housing 4 in the longitudinal direction. Latch portions 41*a* and 41*b* for latching the contact pins $T_1$, $T_1$ are formed in the receiving holes 41 and 42 respectively. One of the latch portions, 41*a*, which is formed inside receiving hole 41, is not shown in the drawings. Movement of the latch portions 41*a*, 41*b* is restricted by the TPA 9. Also, a tubular seal member 8 and the TPA 9 are fitted onto the outer periphery of the inner housing 4.

Figure 7A:
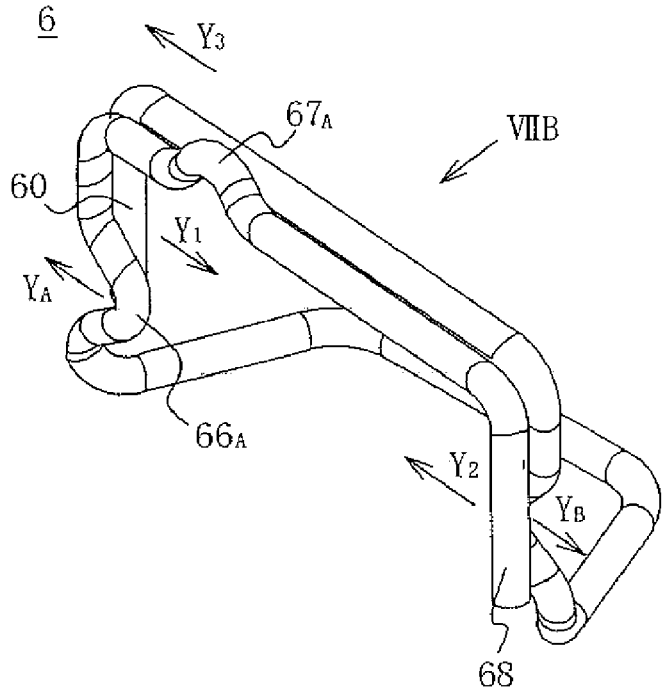
FIG. 7 illustrates the clip member in FIG. 1, FIG. 7A being an enlarged perspective view of the clip member in FIG. 2 and FIG. 7B being a perspective view from direction VIIB in FIG. 7A.
Figure 7B:
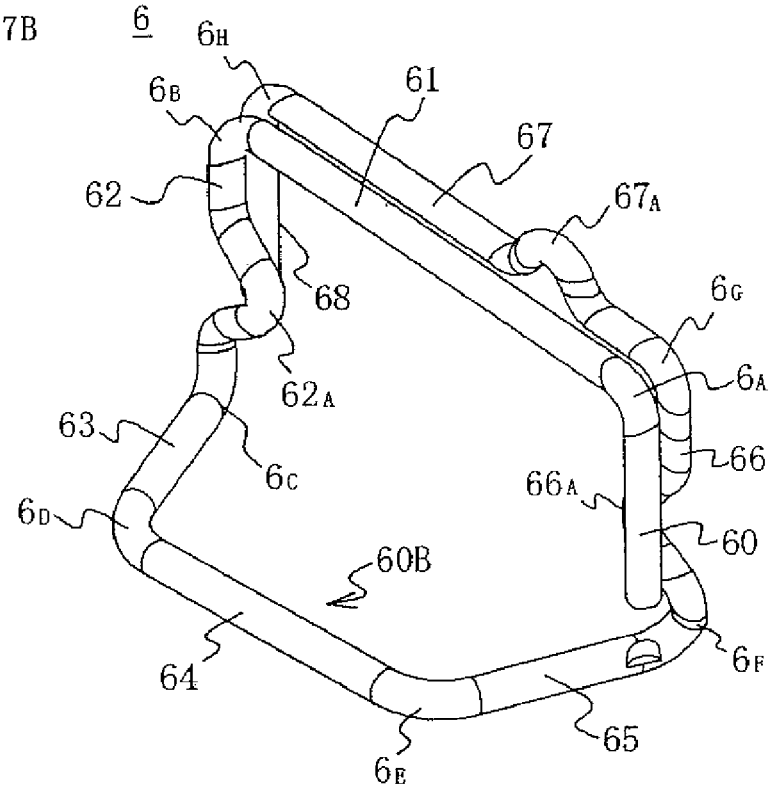

FIG. 7 illustrates the clip member in FIG. 1, FIG. 7A being an enlarged perspective view of the clip member in FIG. 2 and FIG. 7B being a perspective view from direction VIIB in FIG. 7A.

The clip member 6 is wound, in a state in which resilience is imparted thereto, onto the outer periphery of the outer housing 3 of the female part 2. To match the shape of the outer housing 3, the clip member 6 is bent in a plurality of bend portions $\mathbf{6}_A$ to $\mathbf{6}_H$, which are joined by coupling portions 60 to 68. Thus the member is formed as a body resembling a single spring wire of a particular thickness. The bottom portion 60B of the clip member 6 is composed of coupling portions 63 to 65 linking the bend portions $\mathbf{6}_C$ to $\mathbf{6}_F$, and is formed to be curved in such a manner as to latch into the step portion $\mathbf{32}_0$ of the bottom 32 of the housing 3. Among the coupling portions 60 to 68 of the clip member 6, the two end portions 60 and 68 are the pressing portions. Also, in the coupling portions 62 and 66, which are proximate to and face the end portions 60 and 68 respectively, there are formed latching protrusions $\mathbf{62}_A$ and $\mathbf{66}_A$ that point inward at each other. These latching protrusions $\mathbf{62}_A$, $\mathbf{66}_A$ are projected through the through-holes 33*a*', 33*b*' in the outer housing 3 into the cavity 30 in the outer housing 3. Further, in the coupling portion 67, which constitutes the upper edge, there is formed an upward-projecting latching protrusion $\mathbf{67}_A$, which engages with the CPA 7. The latching protrusion $\mathbf{67}_A$ is located on a vertical virtual line that crosses at right angles, roughly near the center, a virtual line joining the latching protrusions $\mathbf{62}_A$ and $\mathbf{66}_A$, and is formed so as to project outward from the coupling portion 67.

When the two end portions 60 and 68 of the clip member 6 are pushed inward toward each other, that is, pushed in the mutually approaching directions indicated by arrows $Y_1$ and $Y_2$ in FIG. 7A, the latching protrusions $\mathbf{62}_A$ and $\mathbf{66}_A$ will move away from each other (in the directions of arrows $Y_A$ and $Y_B$ in FIG. 7A). With the clip member 6 wound onto the female part 2, such motion will mean that the latching protrusions $\mathbf{62}_A$, $\mathbf{66}_A$ move through the cavity 30 in directions in which they are drawn into the through-holes 33*a*', 34*b*', and as a result, are withdrawn from the latching slots $\mathbf{11}_A$, $\mathbf{11}_B$ of the male part 10 when the female part 2 and male part 10 are in the coupled state.

Further, when the male part 10 is inserted into the female part 2, the latching protrusions $\mathbf{62}_A$, $\mathbf{66}_A$ will move in the directions of arrows $Y_A$ and $Y_B$ because of being pushed by the saliencies $\mathbf{11}_0$, $\mathbf{11}_0$ of the male housing 11, and simultaneously with such motion, the latching protrusion $\mathbf{67}_A$ will be slid in direction $Y_3$. Such motion of the latching protrusion 67A removes the restriction on movement of the CPA 7's latching bar 73*a*', to be described later, so that the CPA 7 can be slid in the mating direction. Since the clip member 6 can be formed by bend-processing of a single spring wire, it can be fabricated simply, and moreover at low cost, to match the shape of the outer housing 3.

Although in the present embodiment the shape of the female part 2's section orthogonal to the longitudinal direction is rectangular, it is not limited to this shape and could equally well be another shape such as oval or circular. Further, the shape of the clip member 6 will be altered to match such shape variation.

As shown in FIGS. 2 and 3, the CPA 7 has: an upper plate portion 73 sufficiently large to cover the top wall 31 of the outer housing 3; side plate portions 71 and 72 sufficiently large to cover partially the two sidewalls 33, 34 of the outer housing 3; and a bottom portion 75 in which are formed guide slots 75*a* and 75*b* that engage with the guiding tab 31*c*. The front is left open as open portion $\mathbf{7}_A$, and the rear is closed over by a rear wall 74. The CPA is formed as an insulating plastic molding and, viewed directly from the front, is composed of members arranged more or less in a broad, inverted U-shape.

At the front (in the direction of mating with the male part) of the upper plate portion 73 there is provided a sensing arm 73*a* which possesses resilience. At the end of this sensing arm 73*a* there is formed a latching bar 73*a*' that latches into the latching protrusion $\mathbf{67}_A$ of the clip member 6. The sensing arm 73*a* performs the function of sensing whether or not mating with the male part 10 has been effected in the regular position.

Resilience is imparted to the sensing arm 73*a* by the thickness of the upper plate portion 73 and by the provision of a pair of slits $\mathbf{73}_1$ and $\mathbf{73}_2$ in the longitudinal direction of the upper plate portion. Also, in the bottom portion 75 there are formed guide slots 75*a* and 75*b*. Further, engaging holes $\mathbf{74}_1$ and $\mathbf{74}_2$ into which the latching bars 31*a*', 31*b*' of the outer housing 3 engage are formed in the rear wall 74 (see FIG. 3A). The CPA 7 is installed so as to be slidable in the back-forward direction of the outer housing 3, that is, in the direction of mating with the male part 10. Further, in the side plate portions 71, 72, near the open portion 7A at the front, there are formed narrow slots $\mathbf{72}_A$, $\mathbf{72}_A$ (see FIG. 9) into which the spring wire-like body of the clip member 6 penetrates.

The tubular seal member 8 has, in its interior, a through-hole $\mathbf{8}_0$ sufficiently large to fit over the outer periphery of the inner housing 4, and, formed on its outer wall, a plurality of concavo-convexities 8*a*, as shown in FIGS. 2 and 3. The tubular seal member 8 is formed from a tubular resilient member of rubber or the like having a particular thickness.

The TPA 9, formed as an insulating plastic molding, has a tubular portion 9*a* with a through-hole $\mathbf{9}_0$ in the interior thereof that is sufficiently large to fit over the outer periphery of the inner housing 4, and a pair of arm pieces $\mathbf{9}_1$ and $\mathbf{9}_2$ that extend outward from the tubular portion 9*a* to a certain distance. The arm pieces $\mathbf{9}_1$ and $\mathbf{9}_2$ perform the function of securing the contact pins $T_1$, $T_2$, by pushing down the latch portions 41*a* and 42*a* that are formed in the receiving holes 41, 42 inside the inner housing 4.

The female part 2 with the structure described above is assembled via the following procedure.

First of all the female contact pins $T_1$, $T_1$, each coupled to a wire W, are inserted through the rear of the receiving holes 41, 42 in the inner housing 4 (see FIGS. 4 and 5). Next, the tubular seal member 8 and the TPA 9 are inserted through the front of the inner housing 4. Insertion of the TPA 9 causes the pair of arm pieces $\mathbf{9}_1$, $\mathbf{9}_2$ of the TPA 9 to push down the latch portions 41*a*, 42*a* inside the receiving holes 41, 42, thereby securing the contact pins $T_1$, $T_1$. FIG. 6 shows the arm piece $\mathbf{9}_2$ engaging the latch portion 42*a*; the engagement of the other arm piece with the latch portion 41*a* is omitted. In this way, even if tensile force in the outward direction is exerted on the wires W, they will not come out. Also, a seal member $W_0$ is inserted through the rear end of the inner housing 4 and seals the spaces around the wires W. Thanks to this, any water droplets or the like that travel along the wires will not enter into the female housing interior. The inner housing 4 thus assembled is inserted through the opening $\mathbf{3}_B$ in the rear of the outer housing 3 and secured in place. Such securing is effected via mating into the tubular portion 35 in which the opening $\mathbf{3}_B$ of the housing 3 is formed.

The clip member 6 is installed to the outer housing 3 either before or after the inner housing 4 is installed. Such installation is effected by stretching out the clip member 6 and fitting it over the outer periphery of the outer housing 3 in such a manner that its latching protrusions $\mathbf{62}_A$, $\mathbf{66}_A$ project into the interior of the outer housing 3 through the through-holes 33*a*', 34*a*'. Through such installation, the single spring wire-like body that constitutes the clip member 6 becomes wound onto the outer wall surface of the outer housing 3. After that, the CPA 7 is installed to the outer housing 3. Such installation is carried out by bringing the two sidewalls 71, 72 of the CPA 7 into contact with the two sidewalls 33, 34 of the housing 3, and furthermore passing the pair of arm pieces 31*a*, 31*b* of the top plate portion 73 through the engaging holes $\mathbf{74}_1$, $\mathbf{74}_2$ and causing the latching bars 31*a*', 31*b*' to latch into the latching step portions $\mathbf{74}_0$ inside the engaging holes $\mathbf{74}_1$, $\mathbf{74}_2$ (see FIG. 6). The latching of the latching bar 31*b*' into the latching step portion $\mathbf{74}_0$ is omitted in FIG. 6. Further, the guide protrusion 31*c* of the outer housing 3 is inserted into the guide slots 75*a*, 75*b* of the CPA 7. In this way, the CPA 7 is installed so as to be readily slidable in the front-back direction of the outer housing 3, that is, the direction of mating with the male part 10, and, thanks to the engaging of the latching bars 31*a*', 31*b*' with the latching step portions $\mathbf{74}_0$, $\mathbf{74}_0$, is retained in place. The CPA 7 is slidable between a standby position and a regular mating position.

The male part 10 has a male housing 11, with a cavity 12, that is sufficiently large to mate into the insertion opening $\mathbf{3}_A$ of the female part 2, and two male contact pins $T_2$, $T_2$ that are mounted inside the male housing 11, as shown in FIGS. 1 and 5. In the opposed sidewall surfaces of the outer periphery of the male housing 11 there are formed engaging slots $\mathbf{11}_A$ and $\mathbf{11}_B$ into which the latching protrusions $\mathbf{62}_A$, $\mathbf{66}_A$ of the clip member 6 engage. Further, in the vicinity of each engaging slot $\mathbf{11}_A$, $\mathbf{11}_B$ there is formed a saliency $\mathbf{11}_0$ that slopes downward in the direction of mating with the female part 2. These saliencies $\mathbf{11}_0$, $\mathbf{11}_0$ perform the function of pushing the latching protrusions $\mathbf{62}_A$, $\mathbf{66}_A$ of the clip member 6 outward from the outer housing 3 during mating with the female part 2.

Next, the methods for mating or decoupling the female part 10 and male part 2 will be described with reference to FIGS. 5, 6, and 8 to 12.

I. Prior to Connection of the Two Parts

In the female part 2 prior to being coupled to the male part 10, the latching protrusions $\mathbf{62}_A$, $\mathbf{66}_A$ of the clip member 6 project into the cavity 30 via the through-holes 33*a*', 33*b*' in the outer housing 3, as shown in FIG. 5. On the other hand, the latching bar 73*a*' of the CPA 7 contacts the latching protrusion 67A of the clip member 6, so that forward motion of the CPA 7, that is, in the direction of mating with the male part 10, is inhibited and thus the sliding motion thereof is restricted.

II. Mating (Coupling)

Figure 8A:
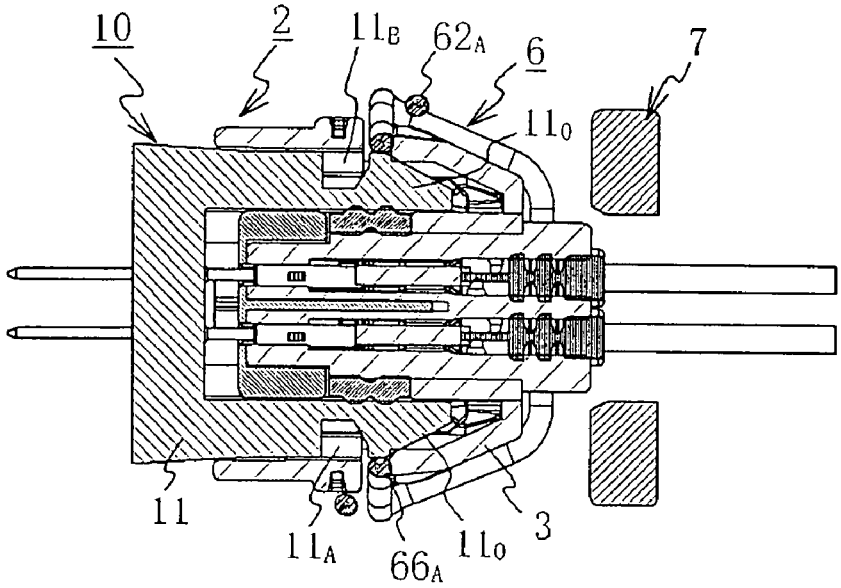
FIG. 8 illustrates the male and female parts in the mated state, FIG. 8A being a sectional view of the parts mated from the state in FIG. 5, and FIG. 8B being a sectional view of the female part mated from the state in FIG. 6.
Figure 8B:
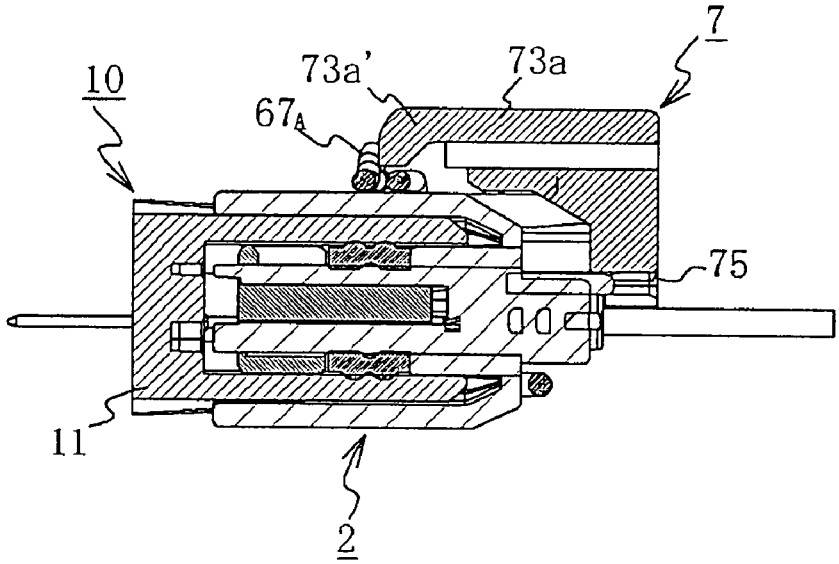

In this state, the housing 11 of the male part 10 is inserted into the insertion opening $\mathbf{3}_A$ of the female part 2, whereupon, as shown in FIG. 8, the saliencies $\mathbf{11}_0$, $\mathbf{11}_0$ of the male housing

11 contact against the latching protrusions $62_A$, $66_A$ of the clip member 6. Then, as the male part 10 is pushed in further, the latching protrusions $62_A$, $66_A$ are pushed along the sloping surfaces of the saliencies $11_0$, $11_0$ and move through the through-holes 33*a*', 34*b*', subsequently being pushed out into the cavity 30. After that, as the male part 10 is pushed in still further and moves past the saliencies $11_0$, $11_0$, the spring resilience of the clip member 6 causes the latching protrusions $62_A$, $66_A$ to engage into the latching slots $11_A$, $11_B$. Such engagement locks the coupling of the male part 10 with the female part 2 (see FIG. 8).

At this point, the latching protrusions $62_A$, $66_A$ of the clip member 6 are pushed out through the cavity 30, and simultaneously the latching protrusion $67_A$ is slid in the direction indicated by $Y_3$ in FIG. 7. When the latching protrusion $67_A$ moves laterally in this way, the position of contact between the latching protrusion $67_A$ and the CPA 7's latching bar 73*a*' shifts, so that the CPA 7 can be slid in the direction of the male part 10. The CPA 7 is then slid in such mating direction, following which the latching protrusions $62_A$, $66_A$ of the clip member 6 enter into the narrow slots 11A, 11B, and simultaneously the latching protrusion $67_A$ returns to its original position. Thus, the latching protrusion $67_A$ engages with the inner face of the latching bar 73*a*' and is restricted from moving rearward (see FIG. 9). As a result, the CPA 7 is able to ensure that the female part 2 and male part 10 are fully coupled in the regular position.

In this way the two parts 2, 10 can be reliably coupled, with semi-mated coupling prevented. More precisely, the fact that the operations of the clip member and sliding sensing member are linked means that the two connector parts 2, 10 are mated and locked reliably. Moreover, mounting of the clip member onto the female housing is effected by clipping the member onto the outer wall surface of the female housing. Therefore such mounting does not require a specially complex shape to be used for the female housing. This means that the female housing is simple to mold, and both connector parts 2, 10 can be made compact. What is more, such mounting is simple.

Figure 9B:
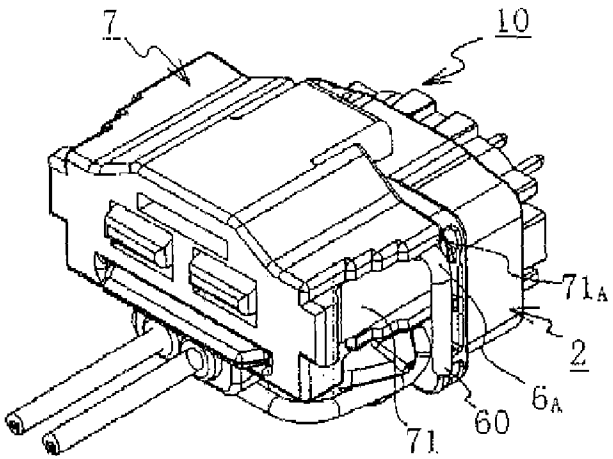
FIG. 9 illustrates the male and female parts mated in the regular position, FIG. 9A being an exterior perspective view and FIG. 9B being the exterior perspective view of FIG. 9A rotated 180 degrees.
Figure 9A:
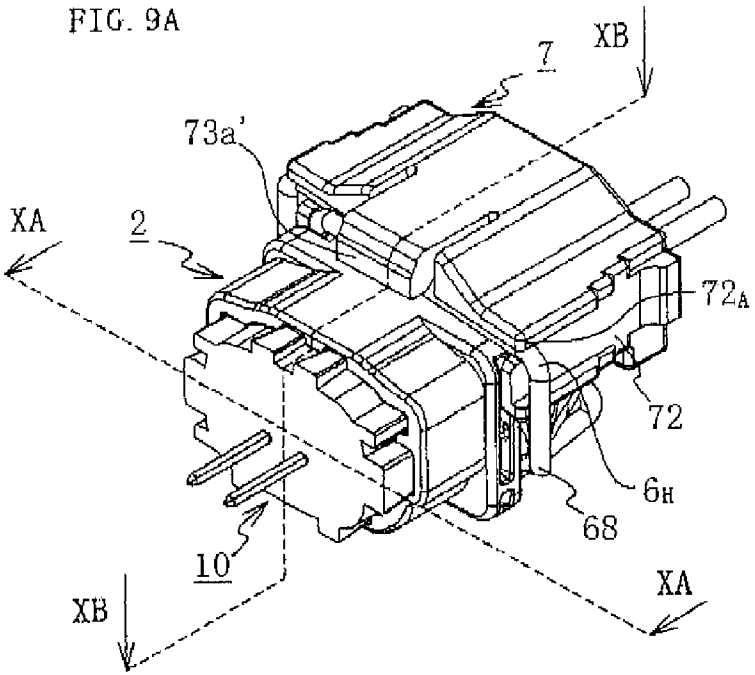

When the female part 2 and the male part 10 are fully mated, the bend portions $6_A$ and $6_H$ of the clip member 6 are fitted into the narrow slots 72A, 72A as shown in FIG. 9, so that even if the end portions 60, 68 of the clip member 6 are pressed, their movement will be restricted since they will contact against the side plate portions 71, 72. More precisely, should it be attempted to push the two end portions 60, 68 toward each other in the directions indicated by arrows $Y_1$ and $Y_2$ in FIG. 7A, such motion will be restricted, the latching protrusions $62_A$, $66_A$ will not execute any motion away from each other (in the directions of arrows $Y_A$ and $Y_B$ in FIG. 7A), and the coupling of the two parts 2, 10 will remain locked. Naturally, movement of the clip member 6's latching protrusion $67_A$ will also be restricted, so that the CPA 7 cannot be slid.

III. Decoupling of the Two Parts

Figure 10A:
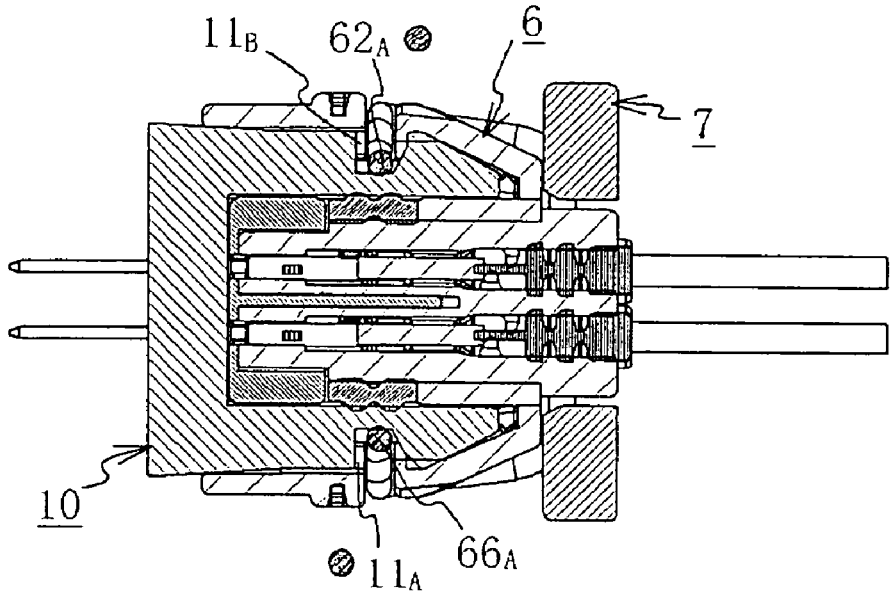
FIG. 10A is a sectional view cut along line XA-XA in FIG. 9A, and FIG. 10 B is a sectional view cut along line XB-XB in FIG. 9A.
Figure 10B:
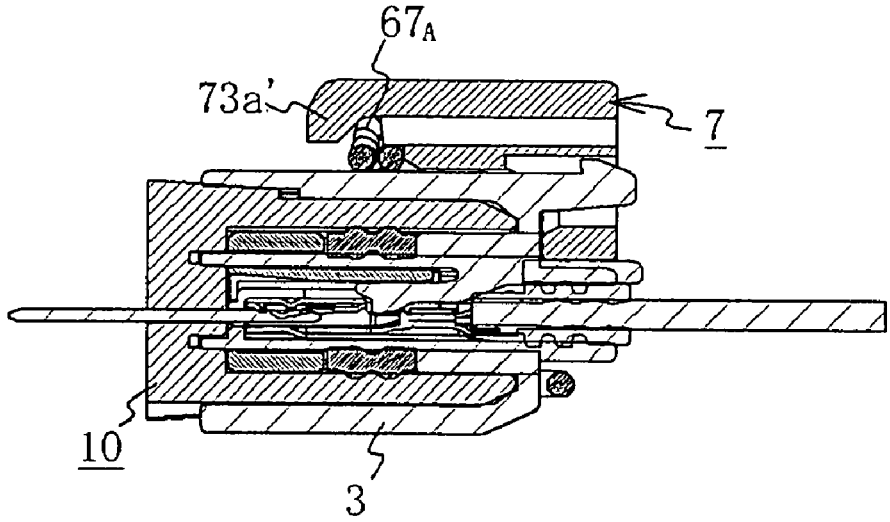
Figure 11A:
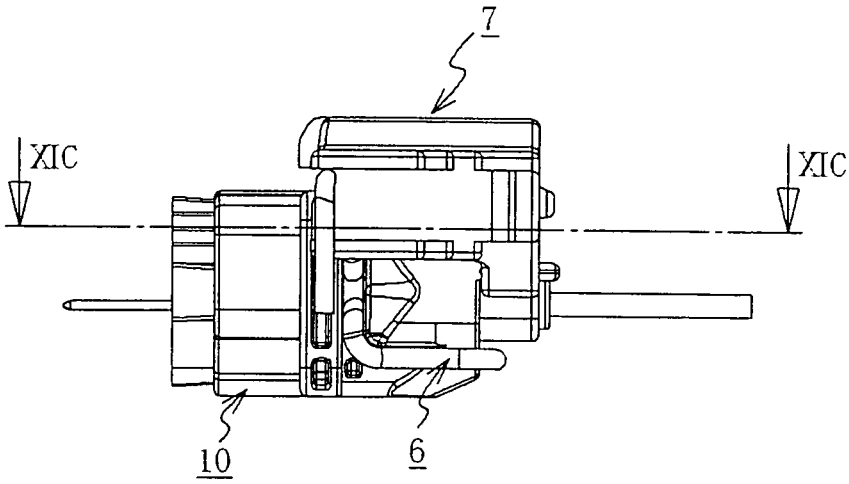
FIG. 11 illustrates the mated state in FIG. 8 from other angles, FIG. 11A being a side view, FIG. 11B a rear view, and FIG. 11C a sectional view cut along line XIC-XIC in FIG. 11A.
Figure 11B:
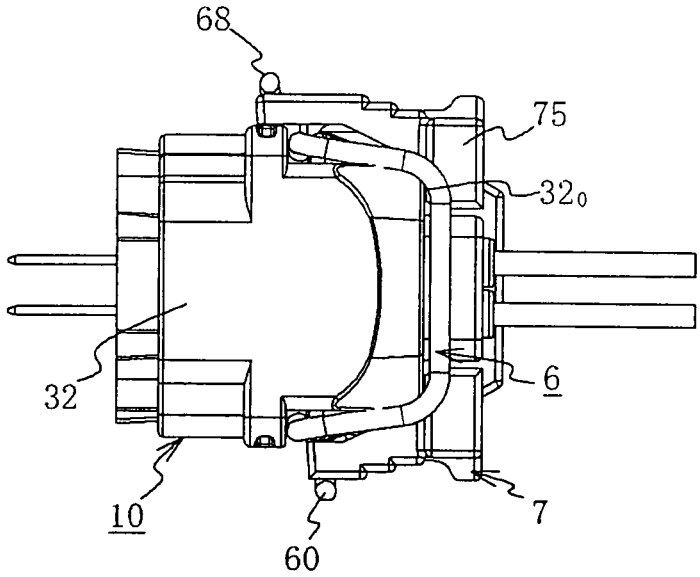
Figure 11C:
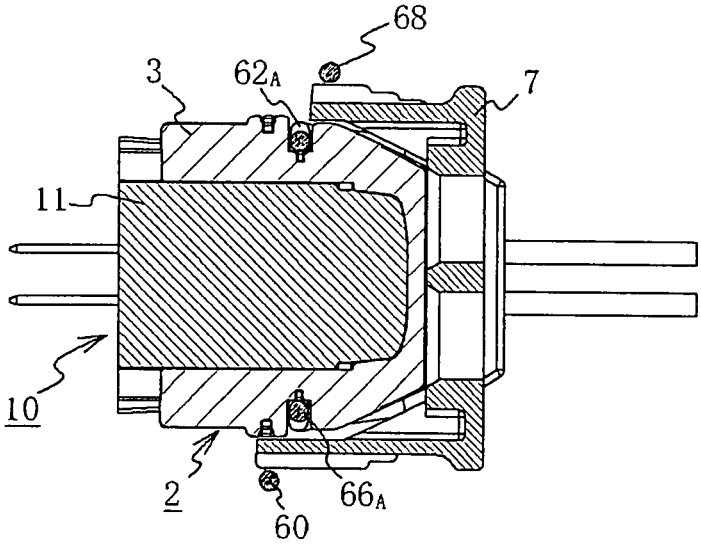
Figure 12:
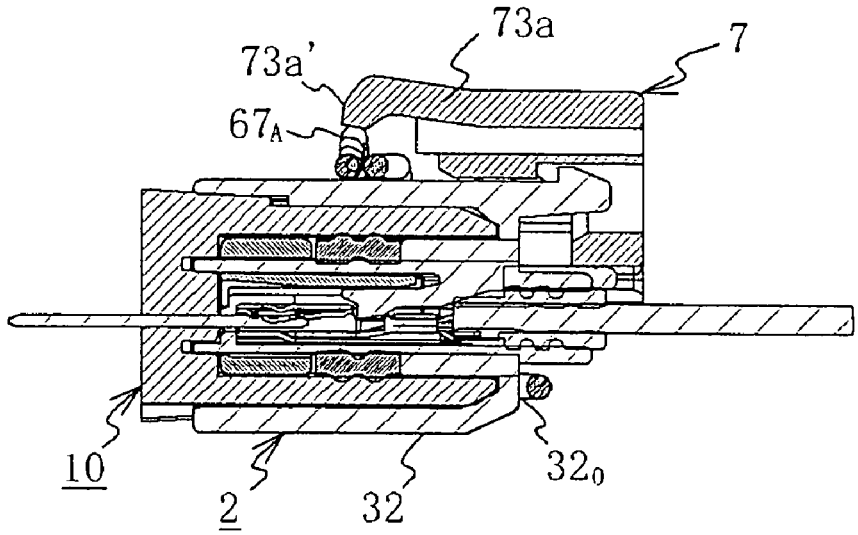
FIG. 12 is a sectional view cut along line XB-XB in FIG. 9A, explicating the separation of the male and female parts.
Figure 13:
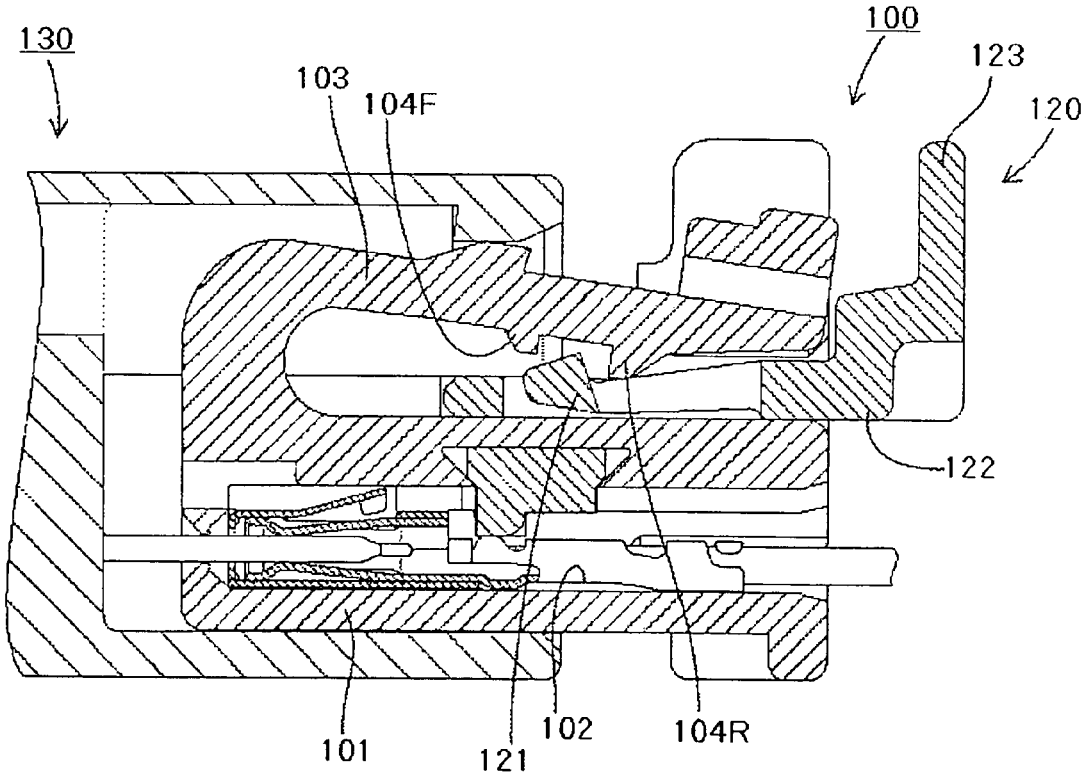
FIG. 13 is a sectional view illustrating a related art electrical connector.

As FIGS. 10 to 12 show, decoupling of the male part 12 and female part 2 is carried out by forcibly retracting the CPA 7 toward the rear of the female part 2. Such forcible retraction is effected by utilizing the resilience of the sensing arm 73 of the CPA 7 to cause the latching bar 73*a*' to move past the latching protrusion $67_A$ of the clip member 6, and so to retract. Thus, when the CPA 7 is pulled and thereby forcibly retracted, and the latching bar 73*a*' of the sensing arm 73 moves past the latching protrusion $67_A$, the bend portions $6_A$, $6_H$ of the clip member 6 disengage from the narrow slots $72_A$, $72_A$, so that it becomes possible to push the two end portions 60, 68 inward toward each other (in the mutually approaching directions indicated by arrows $Y_1$ and $Y_2$ in FIG. 7A); when such pushing is effected, the latching protrusions $62_A$, $66_A$ will move away from each other (in the directions of arrows $Y_A$ and $Y_B$ in FIG. 7A), and as a result of such motion the latching protrusions $62_A$, $66_A$ will withdraw from the latching slots $11_A$, $11_B$ of the male part 10, so that the male part 10 can be pulled out. In this way, the disengagement of the CPA 7's latching bar 73*a*' and the clip member 6's latching protrusion $67_A$ is carried out by utilizing the resilience of the sensing arm 73, which means that no special tool or the like is required for such disengagement.

What is claimed is:

1. An electrical connector comprising:

a first connector part that has a male housing provided with an engaging portion on an outer periphery thereof;

a second connector part that has a female housing provided with a portion defining a cavity for receiving said male housing;

sensing means that senses a mated state of said first and second parts; and locking means that locks said first and second parts in the mated state at a regular mating position;

said locking means being made of a clip member made of a spring wire-like body and having a first latch portion that latches into the engaging portion of said male housing and a second latch portion that latches into said sensing means, and said sensing means being made of a sliding sensing member having a sensing arm made of a resilient piece provided with an engaging portion that latches into the second latch portion of said clip member; and said female housing at an outer wall thereof being provided with a portion defining a through-hole that projects the first latch portion of said clip member into said cavity; the spring wire-like body of said clip member being mounted onto a surface of the outer wall, and said sliding sensing member being fitted also onto the surface of the outer wall slidably in a mating direction of said first and second connector parts, so that with said first and second connector parts mated the first latch portion of said clip member engages with the engaging portion of said male housing, and the engaging portion of said sliding sensing member latches into the second latch portion of said clip member.

2. The electrical connector according to claim 1, wherein both ends of said clip member are provided with pressing portions for moving said first and second latch portions, and said first and second connector parts are decoupled by the pressing portions' being pushed.

3. The electrical connector according to claim 1, wherein the spring wire-like body of said clip member is made of a single linear spring wire that is bent into a shape along the outer wall of said female housing, and said first and second latch portions are provided to the linear spring wire.

4. The electrical connector according to claim 3, wherein a section of said female housing that is orthogonal to a longitudinal direction thereof is one of rectangular, elliptical, and circular, and said clip member is bent into a rectangular, elliptical or circular shape along the female housing and wound like a coil;

said first latch portion including a pair of opposed first and second protruding portions that project inward of said clip member; and said second latch portion including a third protruding portion located on a virtual line that is orthogonal to another virtual line joining said first and second protruding portions and projecting outward of said clip member.

5. The electrical connector according to claim 1, wherein said sliding sensing member includes a pair of opposed first and second sidewall portions that contact against the outer periphery of said female housing, and a coupling portion that couples said first and second sidewall portions, and said sensing arm made of the resilient piece is provided to said coupling portion.

6. The electrical connector according to claim 5, wherein each of said first and second sidewall portions is provided with a locking portion that inhibits actuation of said clip member with said first and second connector parts mated in the regular position.

* * * * *

UNITED STATES PATENT AND TRADEMARK OFFICE

CERTIFICATE OF CORRECTION

PATENT NO. : 7,479,025 B2
APPLICATION NO. : 11/899665
DATED : January 20, 2009
INVENTOR(S) : Kien Sheng Lee et al.

It is certified that error appears in the above-identified patent and that said Letters Patent is hereby corrected as shown below:

In the Claims:

In Claim 1, column 10, line 34, the word "thereofbeing" should be

-- thereof being --.

Signed and Sealed this

Seventh Day of April, 2009

JOHN DOLL
*Acting Director of the United States Patent and Trademark Office*